US010858157B1

(12) United States Patent
Abel

(10) Patent No.: US 10,858,157 B1
(45) Date of Patent: Dec. 8, 2020

(54) LID FOR DRINKING CUP

(71) Applicant: Don E. Abel, Olney, IL (US)

(72) Inventor: Don E. Abel, Olney, IL (US)

( * ) Notice: Subject to any disclaimer, the term of this patent is extended or adjusted under 35 U.S.C. 154(b) by 322 days.

(21) Appl. No.: 15/661,343

(22) Filed: Jul. 27, 2017

Related U.S. Application Data

(60) Provisional application No. 62/367,381, filed on Jul. 27, 2016.

(51) Int. Cl.

| | |
|---|---|
| ***B65D 47/20*** | (2006.01) |
| ***B65D 43/02*** | (2006.01) |
| ***B65D 47/06*** | (2006.01) |
| ***B65B 7/28*** | (2006.01) |

(52) U.S. Cl.
CPC ..... *B65D 47/20* (2013.01); *B65B 7/28* (2013.01); *B65D 43/0202* (2013.01); *B65D 47/06* (2013.01); *B65D 2543/00046* (2013.01)

(58) Field of Classification Search
CPC .... B65D 47/20; B65D 43/0202; B65D 47/06; B65D 2543/00046; B65D 47/0823; A47G 19/2272; B65B 7/28
USPC ..... 220/711, 713
See application file for complete search history.

(56) References Cited

U.S. PATENT DOCUMENTS 4,127,212 A * 11/1978 Waterbury ..... B65D 17/506 220/255.1
4,138,033 A * 2/1979 Payne ..... B65D 47/2018 220/254.3
4,170,724 A * 10/1979 Waterbury ..... B65D 17/506 206/807
4,190,174 A * 2/1980 Haimowitz ..... B65D 47/2018 220/254.3
4,331,255 A * 5/1982 Fournier ..... B65D 47/06 220/257.2
5,086,941 A * 2/1992 English ..... B65D 55/024 220/345.2
5,706,972 A * 1/1998 Sousa ..... A47G 19/2272 220/254.5
D477,223 S * 7/2003 Smith ..... D9/447
6,824,003 B1 * 11/2004 Wong ..... B65D 43/0202 220/254.9

(Continued)

*Primary Examiner* — Ernesto A Grano
(74) *Attorney, Agent, or Firm* — Gary K. Price

(57) ABSTRACT

A lid for a drinking cup that is particularly suitable for use with disposable cups. The lid generally includes a lid cover portion and a tab member portion, Both the lid cover portion and the tab member portion include a lower perimeter flange that is configured to fit snugly over the upper rim of the coffee cup. The lid cover portion includes a first opening formed and a second opening formed in a recessed portion of the lid cover portion. The tab member portion includes a first raised member and a second raised member formed in a recessed portion of the tab member portion. The first raised member sized and shaped to be received within the first opening, and the second raised member sized and shaped to be received within the second opening. In application, the user secures the tab member portion to the upper rim of the coffee cup and aligns the lid cover portion over the tab member such that the first raised member passes through the first opening and the second raised member passes through the second opening. The lid cover portion is then secured to the upper rim of the cup and to the perimeter flange of the tab member portion.

4 Claims, 9 Drawing Sheets

(56) References Cited

U.S. PATENT DOCUMENTS 7,275,653 B2 * 10/2007 Tedford, Jr. ..... B65D 47/286 220/254.9
7,959,029 B2 * 6/2011 Whitaker ..... B65D 43/0212 215/387
8,215,513 B1 * 7/2012 Grissom ..... B65D 17/02 220/268
8,919,593 B2 * 12/2014 Sinacori ..... B65D 47/286 220/254.9
9,908,667 B1 * 3/2018 Smith ..... A47G 19/2272
2003/0089713 A1 * 5/2003 Belt ..... B65D 47/265 220/253
2006/0081633 A1 * 4/2006 Schmidtner ..... B65D 43/0208 220/254.9
2006/0096983 A1 * 5/2006 Patterson ..... B65D 47/265 220/253
2006/0261068 A1 * 11/2006 Schmidtner ..... B65D 43/0208 220/254.9
2006/0283859 A1 * 12/2006 Lu ..... A47G 19/2272 220/253
2007/0278228 A1 * 12/2007 Wong ..... B65D 47/286 220/254.9
2008/0190946 A1 * 8/2008 Wong ..... B65D 47/286 220/711
2008/0272134 A1 * 11/2008 Rohe ..... A45F 3/16 220/713
2009/0065518 A1 * 3/2009 Carnevali ..... B65D 43/0212 220/711
2011/0068113 A1 * 3/2011 Kim ..... B65D 43/0212 220/713
2012/0067890 A1 * 3/2012 Cahen ..... A45F 3/18 220/254.3
2012/0097690 A1 * 4/2012 Chien ..... B65D 43/0212 220/713
2014/0048549 A1 * 2/2014 Wille ..... B65D 43/0222 220/713
2015/0250340 A1 * 9/2015 Liu ..... B65D 43/02 220/254.9
2015/0329253 A1 * 11/2015 Coloneri ..... B65D 51/1683 220/203.04
2017/0071379 A1 * 3/2017 Savenok ..... A47G 19/2272
2017/0099969 A1 * 4/2017 Coon ..... B65D 47/241
2017/0224139 A1 * 8/2017 Santos, III ..... B65D 25/48
2017/0369214 A1 * 12/2017 Seidler ..... B65D 47/0823

* cited by examiner

LID FOR DRINKING CUP

CROSS REFERENCES TO RELATED APPLICATIONS

U.S. Provisional Application for Patent No. 62/367,381, filed Jul. 27, 2016, with title "Lid for Drinking Cup" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

The present invention relates generally to a lid for use in combination with a drinking cup and more particularly to a lid enabling drinking from the cup without removal of the lid.

2. Brief Description of Prior Art

It is well known to apply disposable lids to disposable drinking cups for carry-out sale of beverages such as coffee. This is done in fast food restaurants which serve the food and drink over the counters, where it can be taken off the premises. Also, these are used in drive-thru restaurants where the car drives to a service window, and the coffee and also other beverages and/or food are served through the window. There are also a number of establishments which serve coffee and/or other beverages exclusively for drive-thru and/or take-out customers.

Some types of prior art lids for these disposable drinking cups have an opening at the perimeter of the lid which permits the person to drink coffee while leaving the lid in place in its closing position. However, when the coffee cup is being handled or passed from one person to another, the movement of the coffee within the cup can sometimes cause the coffee to spill through the opening.

It has also been a practice in some drive-in or drive-thru restaurants to use a piece of flexible material to cover the lid opening when the coffee is being served. Then the person can remove the cover when he or she begins drinking the coffee.

The cover may also be a hinged flap that is provided with a tab that is a releasable holding means to keep the flap closed, thereby closing the drink opening. However, this flap design as known in the prior art, can be a nuisance to the user while drinking from the cup and lid with the flap in the open position. In particular, the opened flap often comes in contact with the user's nose or upper lip which is undesirable.

It would be an improvement in the art to provide a lid for a drinking cup that is simple to manufacture, that is secured to the drinking cup and maintains the integrity of the seal around the rim of the cup, and where the lid includes a suitable opening with a means to selectively open and close the opening and avoid the unpleasant experience of the cover portion coming in contact with the user when in the open position.

As will be seen from the subsequent description, the preferred embodiments of the present invention overcome disadvantages of the prior art cup lids.

SUMMARY OF THE INVENTION

The present invention is a lid for a drinking cup that can be used with cups of various types, and is particularly suitable for use with disposable cups of the type commonly used as carry-out containers for beverages such as coffee and the like. The lid generally includes a lid cover portion and a tab member portion. Both the lid cover portion and the tab member portion include a lower perimeter flange that is configured to fit snugly over the upper rim of the coffee cup.

The lid cover portion includes a first opening formed in the cover portion between a recessed portion and a circumferential lip, and a second opening formed in a bottom surface of the recessed portion.

The tab member portion includes a first raised member formed on the cover portion of the tab member, and a second raised member formed approximately adjacent to an end of the bottom surface of a recessed portion of the tab member. The first raised member sized and shaped to be received within the first opening, and the second raised member sized and shaped to be received within the second opening.

In application, the user first secures the lower perimeter flange of the tab member to the upper dm of the coffee cup. The lid portion cover is then aligned on top of the tab member such that the first raised member passes through the first opening of the lid cover portion and the second raised member passes through the second opening of the lid cover portion. The lower perimeter flange of the lid cover portion is then secured to the upper rim of the cup and to the perimeter flange of the tab member portion. When the user takes a drink from the drinking cup, the user presses the first raised member in a downward direction causing the second raised member to downwardly separate from the second opening placing the lid in an open position for drinking.

Manually releasing the first raised member causes the first raised member to upwardly pass through the first opening and causing the second raised member to upwardly pass through the second opening and return to a closed position.

DESCRIPTION OF THE PREFERRED EMBODIMENT

Figure 1:
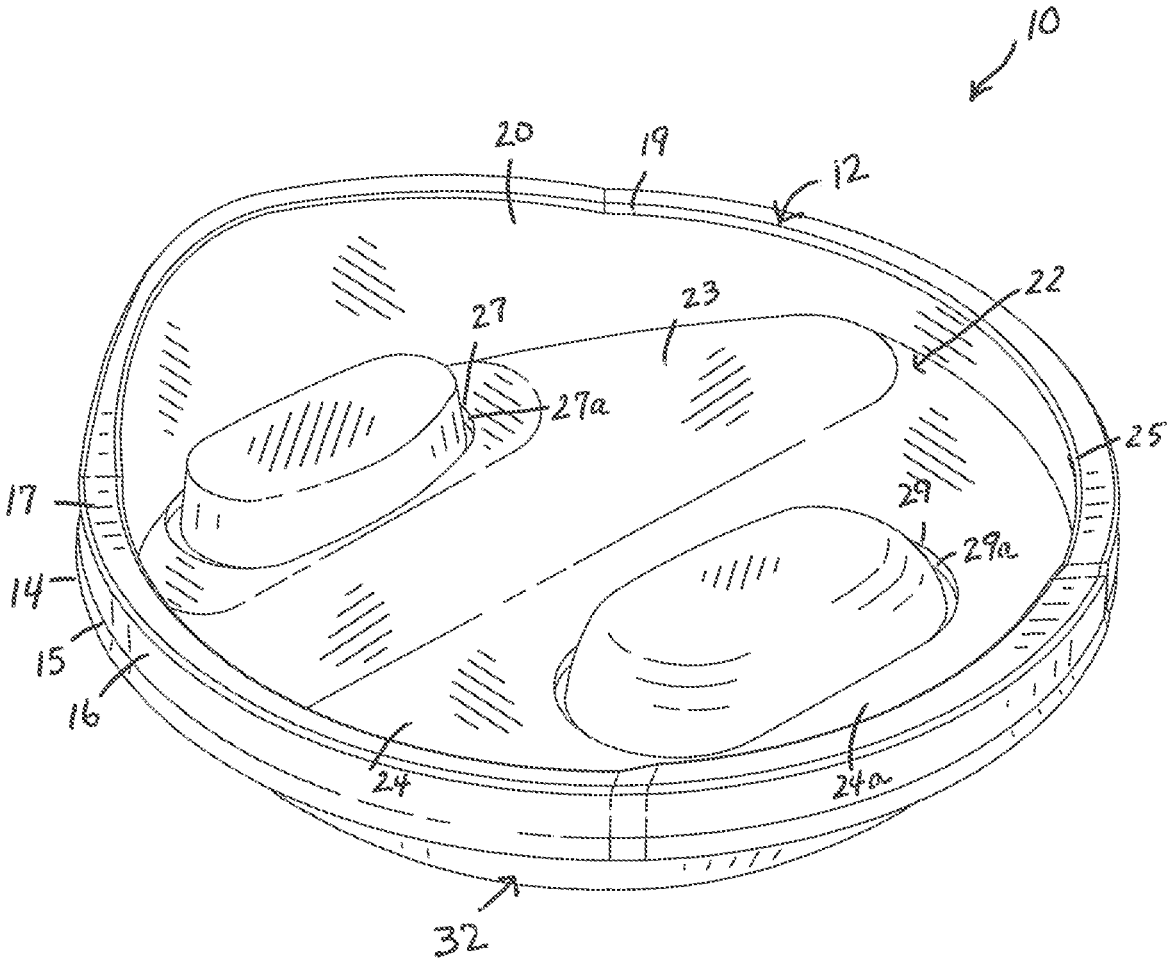
FIG. 1 is a top isometric view of a preferred embodiment of the present invention, a lid for drinking cup.
Figure 2:
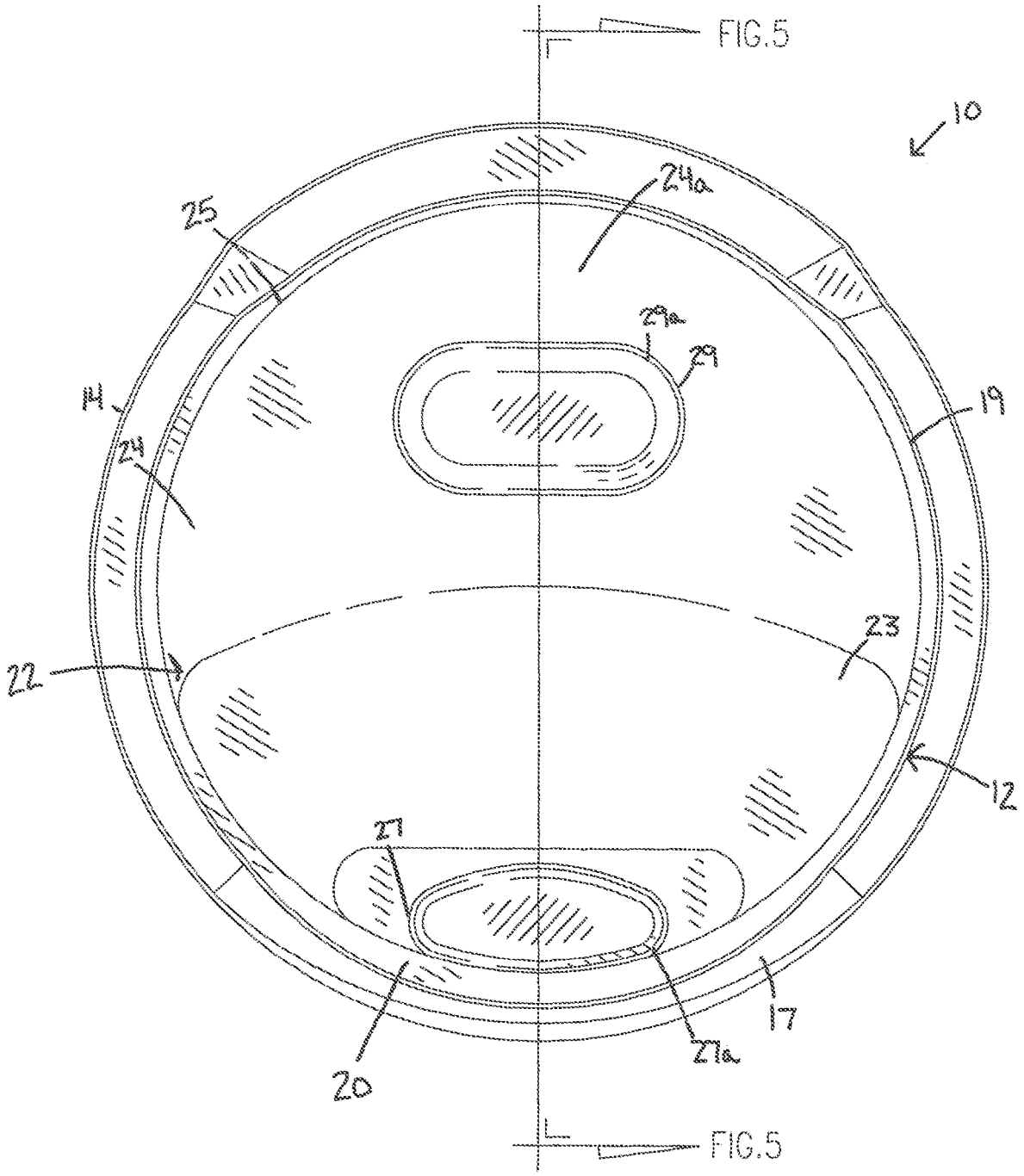
FIG. 2 is a top assembly view of the lid device shown in FIG. 1.
Figure 3:
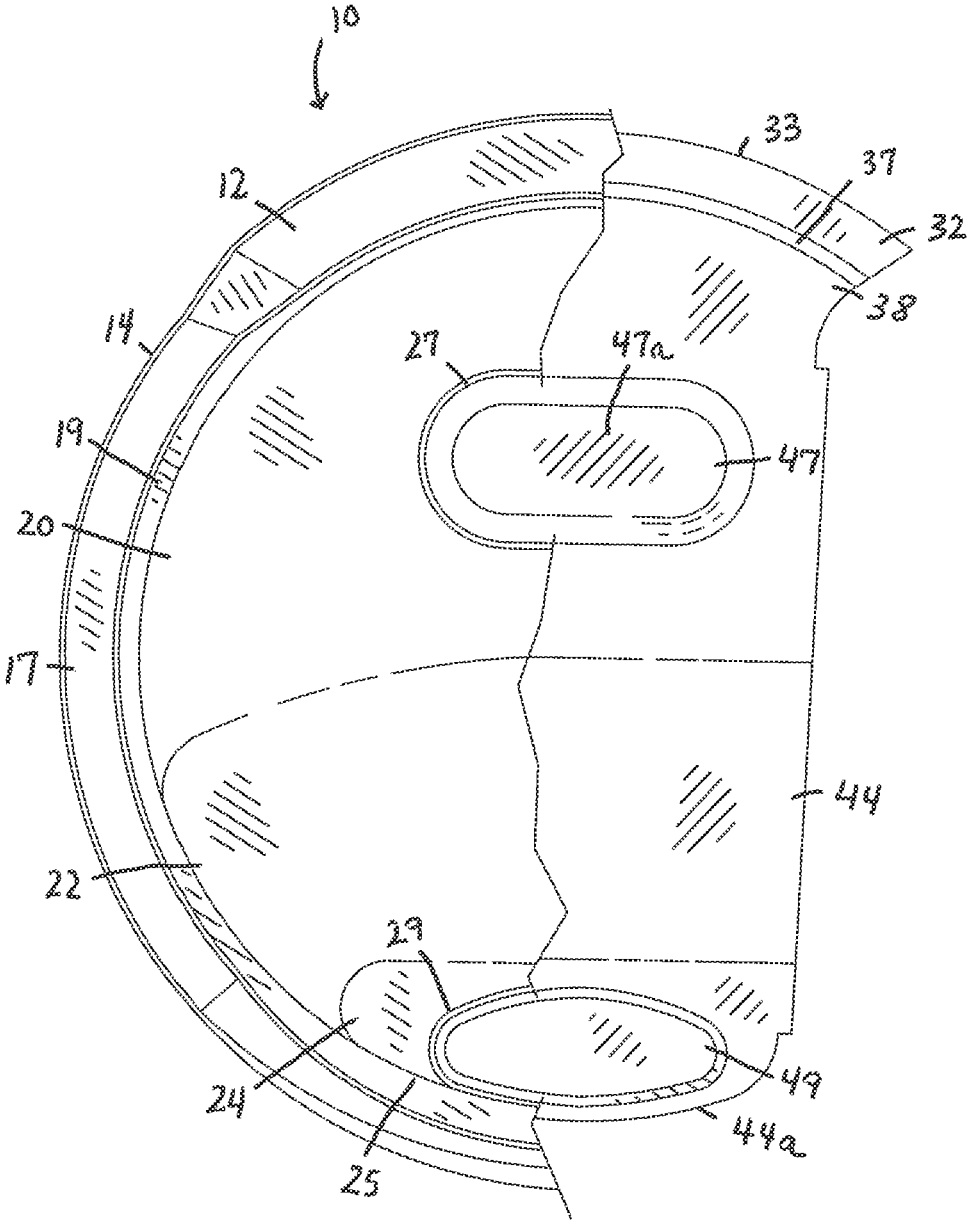
FIG. 3 is a top broken view of the lid shown in FIGS. 1 and 2.
Figure 4:
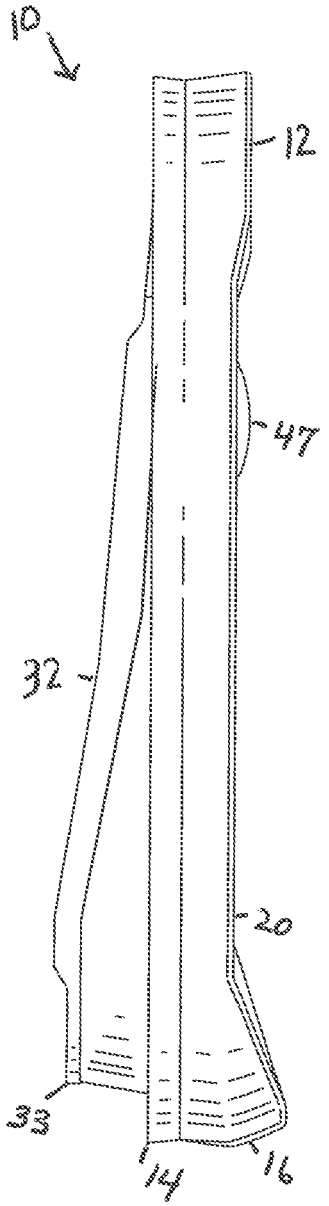
FIG. 4 is a side assembly view thereof.
Figure 5:
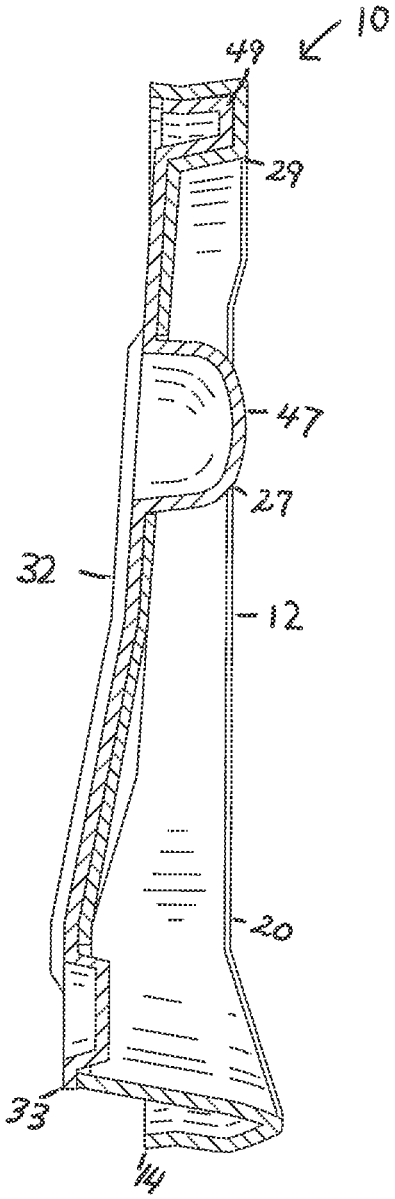
FIG. 5 is a section view thereof.

The present invention is generally embodied in a lid 10 for a drinking cup (not shown). The lid 10 may be used with cups of various types, and is particularly suitable for use with disposable cups of the type commonly used as carry-out containers for beverages such as coffee and the like.

The lid 10 provides a cover for the drinking cup which inhibits spillage and reduces heat transfer between the beverage and the surrounding atmosphere, and is secured in place on the drinking cup by an outer perimeter flange which engages the upper rim of the drinking cup. As will be described, the present invention is provided to enable drinking from the drinking cup without removal of the lid, and is configured so that the user can selectively open and close the opening in the lid and avoid the unpleasant experience of a portion of the lid coming in contact with the user when in the open position. In the broadest context, the lid for drinking cup of the present invention consists of components configured and correlated with respect to each other so as to attain the desired objectives.

The lid 10 generally includes a lid cover portion 12 and a tab member portion 32. The lid cover portion 12 includes a lower perimeter flange 14 which extends around the upper rim of the coffee cup (not shown).

In particular, the lower perimeter flange 14 is a circular circumferential flange and is adapted to fit snugly over the upper rim of the cup. Spaced a short distance radially inwardly from the outer perimeter flange 14, there is a raised perimeter portion 15 having an outer perimeter wall 16 and a top horizontal perimeter wall 17 extending radially inwardly from the outer perimeter wall 16, and then relatively short downwardly extending, inwardly facing circumferential lip 19. Connected to the lip 19 is horizontal cover portion 20 having a generally circular configuration.

The cover portion 20 has a downwardly formed recessed portion 22 in the form of a segment of a circle having a wall 23 (that may be slanted or vertical) that is approximately centered or spaced a short distance away from the center of the cover portion 20, a bottom surface 24 and a circularly radially outward, curved outer recess wall 25 which is axially aligned with, and a downward extension of, the inner lip 19.

As illustrated, there is a first opening 27 formed in the cover portion 20 between the recessed portion 22 and lip 19, and a second opening 29 formed in the bottom surface 24 adjacent to the wall 25 of the recessed portion 22.

The first opening 27 has an inner edge 27*a*, and the second opening 29 similarly defines an inner edge 29*a*, As further illustrated, the first and second openings 27, 29 each having an elongated circular shape, and overall configuration of a symmetrical oval.

Figure 6:
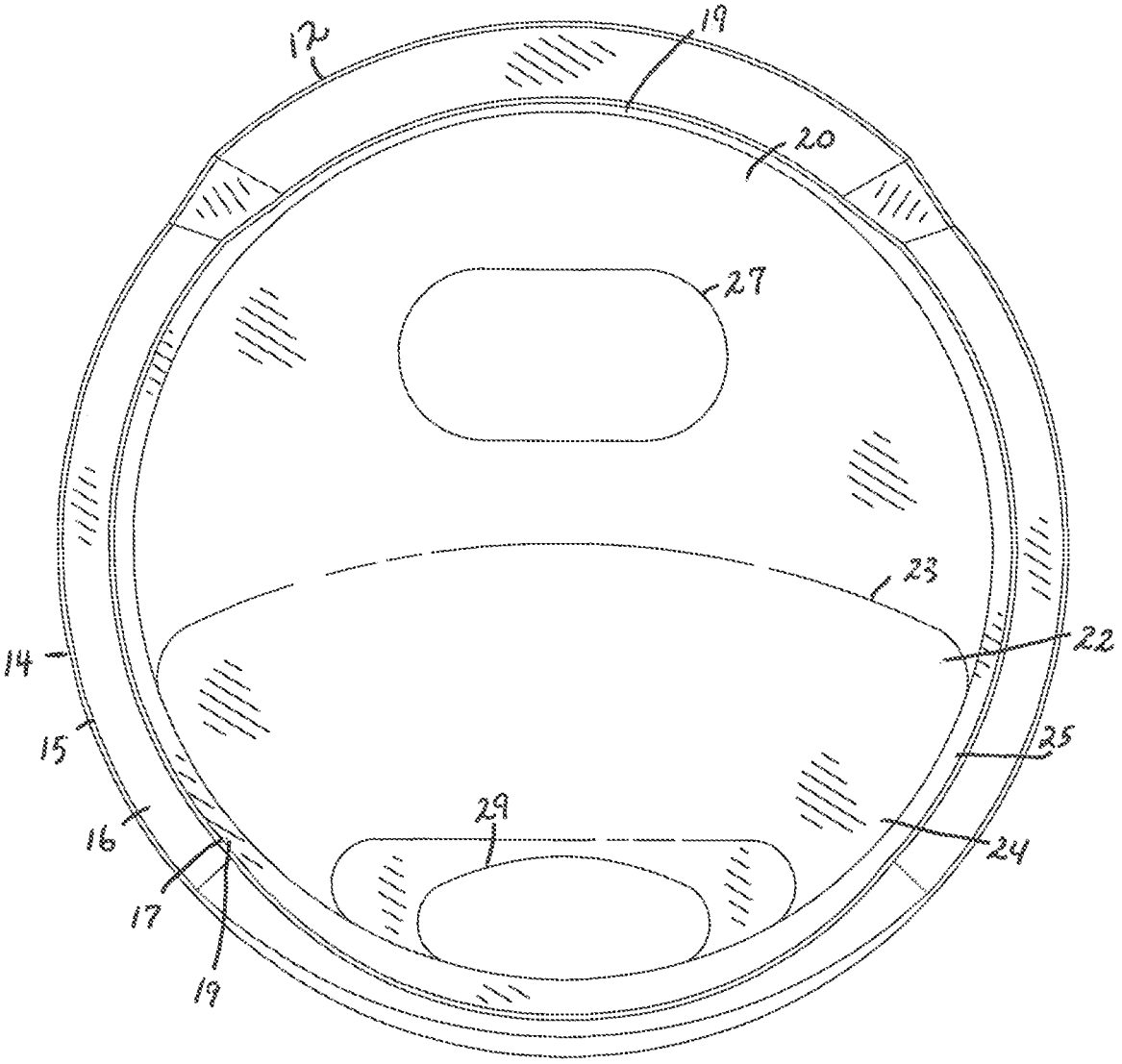
FIG. 6 is a top view of the lid cover portion.
Figure 7:
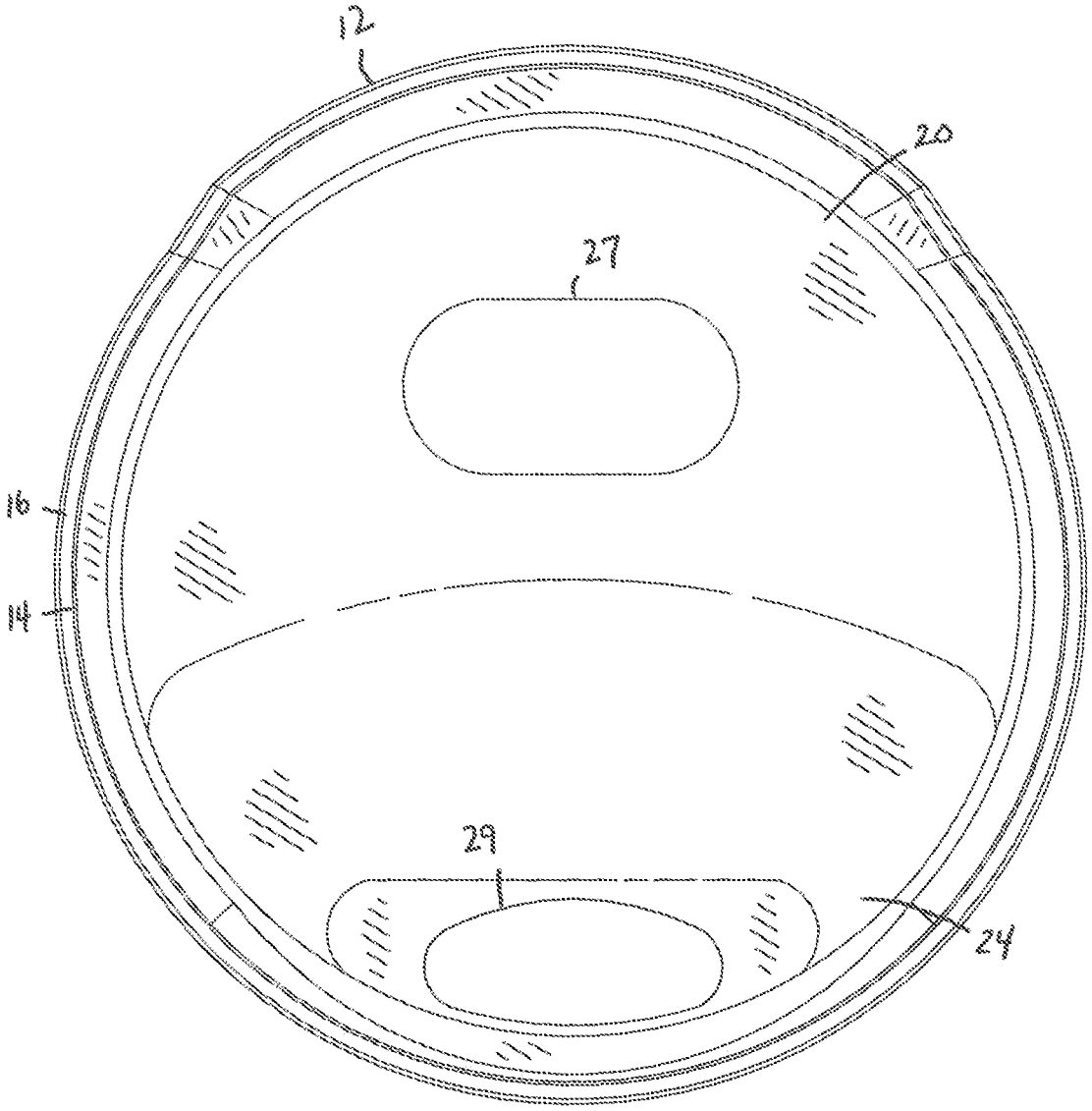
FIG. 7 is a bottom view of the lid cover portion.
Figure 8:
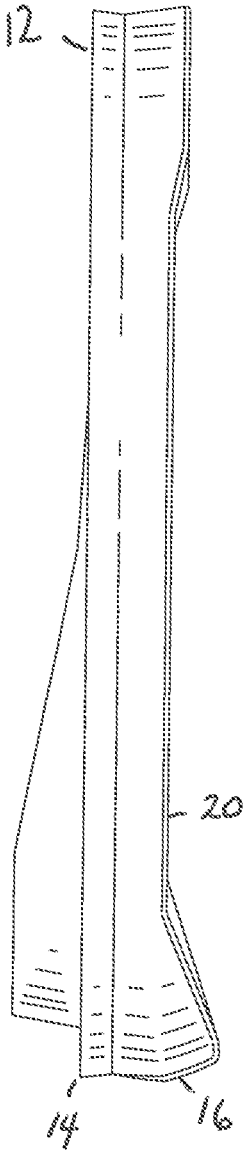
FIG. 8 is a side view of the lid cover portion.
Figure 9:
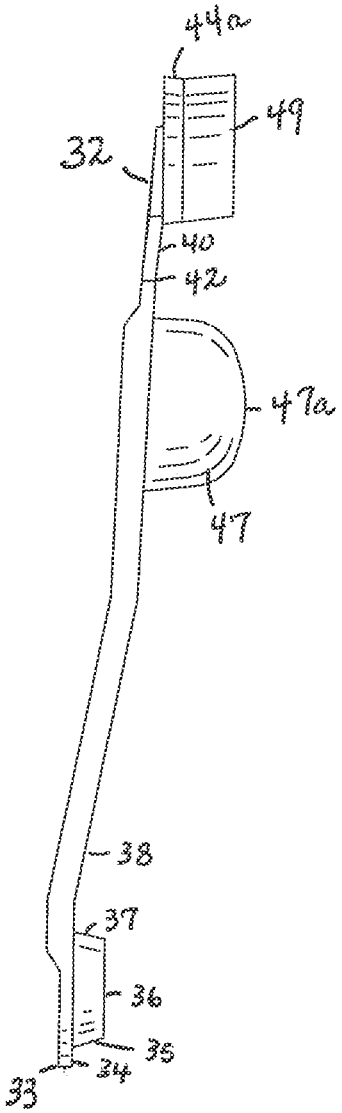
FIG. 9 is a side view of the tab member portion.
Figure 10:
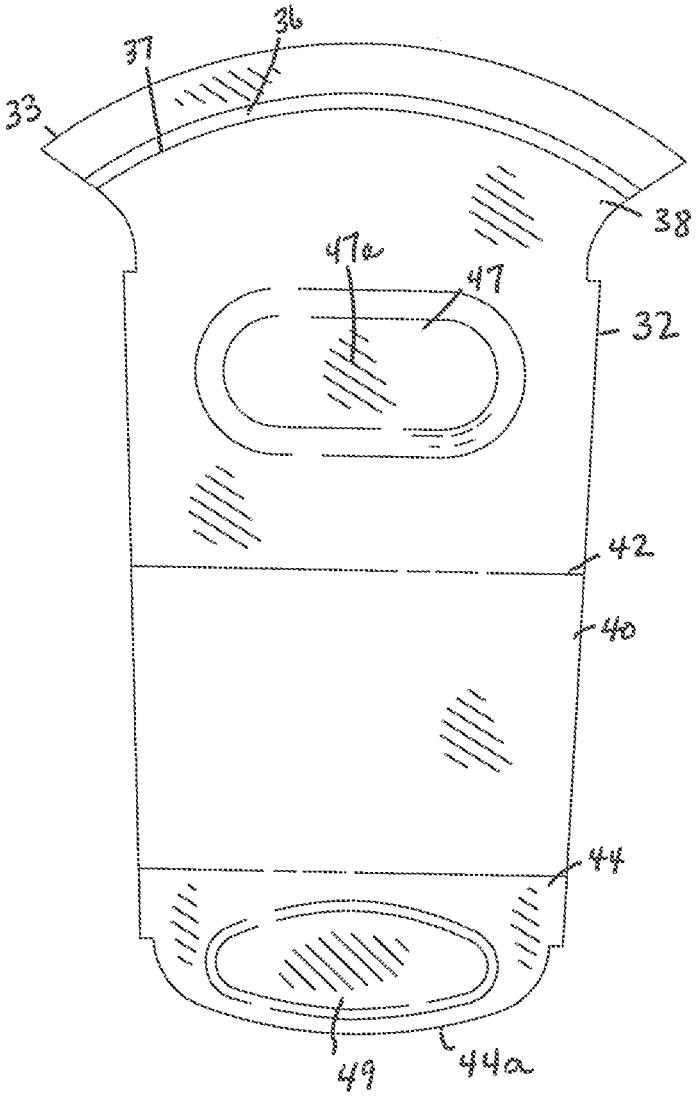
FIG. 10 is a top view of the tab member portion.
Figure 11:
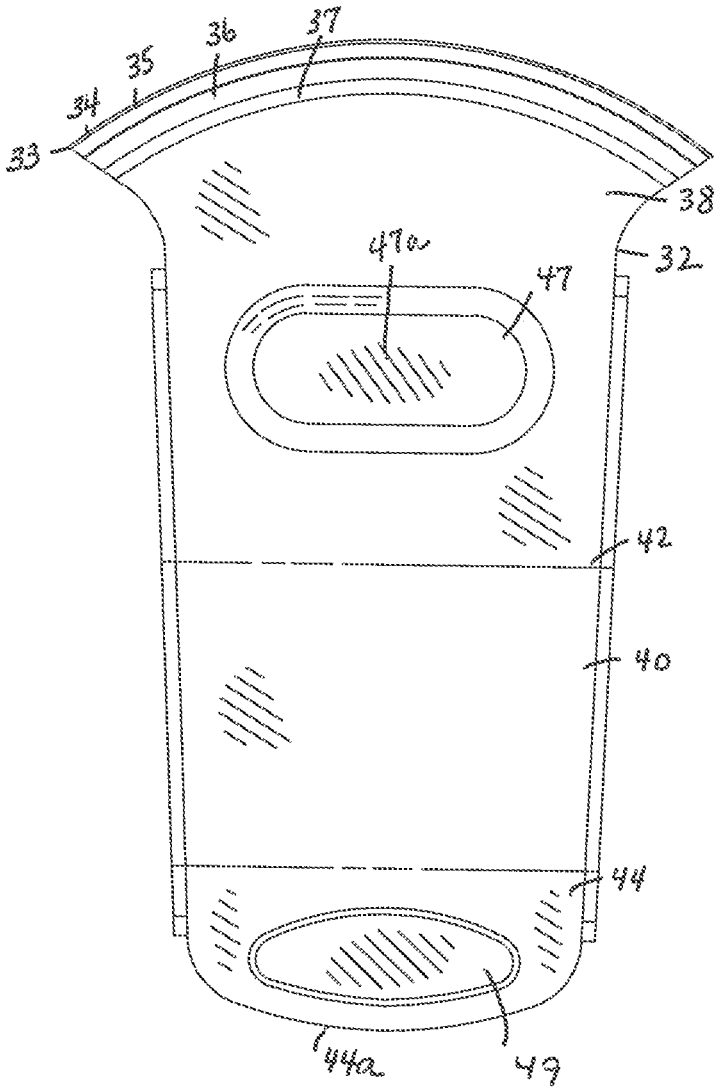
FIG. 11 is a bottom view of the tab member portion.

As further illustrated, the second opening 29 may define (FIG. 1) a small perimeter surface, designated as numeral 24*a*, between the second opening 29 and the wall 25. However, the second opening may be in abutting relation (FIG. 6) with the outer recess wall 25.

The tab member portion 32 is preferably separate and distinct from the lid cover portion 12. The tab member portion 32 includes a lower perimeter flange 33 which extends around a portion of the upper rim of the coffee cup (not shown). In particular, the lower perimeter flange 33 is a circular circumferential flange and is adapted to fit snugly over a portion of the upper rim of the coffee cup.

Preferably spaced a short distance radially inwardly from the outer perimeter flange 33, there is a raised perimeter portion 34, comprising an outer perimeter wall 35, and a top horizontal perimeter wall 36 extending radially inwardly from the outer wall 35, and then relatively short downwardly extending, inwardly facing circumferential lip 37. Connected to the lip 37 is horizontal cover portion 38 in the form of a segment of a circle.

The cover portion 38 has a downwardly formed recess portion 40 having a generally vertically aligned planar recess wall 42, and a bottom surface 44.

As illustrated, the tab member portion 32 includes a first raised member 47 formed on the cover portion 38, and a second raised member 49 formed approximately adjacent to an end 44*a* of the bottom surface 44.

As illustrated, the first and second raised members 47, 49 having a generally symmetrically oval configuration. In particular, the first raised member 47 sized and shaped to be received within the first opening 27 such that the raised member 47 is in abutting communication with the inner edge 27*a*. The second raised member 49 sized and shaped to be received within the second opening 29 such that the second raised member 49 is in abutting communication with the inner edge 29*a* of the second opening 29.

In application, the user first secures the tab member portion 32 to the upper rim of the cup. In particular, the lower perimeter flange 33 is appropriately secured to the upper rim of the coffee cup. Next, the lid portion cover 12 is aligned on top of the tab member 32 such that the first raised member 47 passes through the first opening 27 of the lid cover portion 12 and the second raised member 49 passes through the second opening 29 of the lid cover portion 12. The lower perimeter flange 14 is then secured to the upper rim of the cup and the perimeter flange 33 of the tab member portion 32.

When the user takes a drink from the drinking cup, the user presses the first raised member 47 in a downward direction until an upper most surface 47*a* of the first raised member 47 is approximately level with the cover portion 20. Pressing the first raised member 47 in a downward direction as described causes the second raised member 49 to downwardly separate from the second opening 29 placing the lid 10 in an open position for drinking.

Manually releasing the first raised member 47 causes the member 47 to upwardly pass through the first opening 27, and causes the second raised member 49 to upwardly pass through the second opening 29 and return to its original, closed position.

It has been found that this particular configuration as described, and structure of the tab member portion 32 in application with the lid cover portion 12 permits it to be very conveniently applied to cover the second opening 29, easily manipulated in order to open the second opening 29 when the user wishes to take a drink and also placed again in its covering/closed position. Further, and as should be understood, this can be accomplished a number of times.

The tab member portion 32 can be readily placed into its covering/closed position by the person who is serving the coffee, and this can be done very quickly and reliably. Then when the user receives the cup of coffee with the tab member portion 32 in the closed position, the user can easily manipulate the tab member portion 32, drink a portion of the coffee, then manipulate the tab member portion 32 in its closed position, this being done also with relative ease and also with a reliable closure being accomplished.

Although the above description above contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A lid for a drinking cup comprising:

a tab member portion and a lid cover portion that is separate from said tab member portion;

said tab member portion including a lower perimeter flange and a raised perimeter portion, wherein the perimeter portion comprises an outer perimeter wall, a top horizontal perimeter wall and an inward facing circumferential lip that are adapted for fitting over an upper rim of a coffee cup, a first cover portion defining a first recess portion having a generally vertically aligned first recess wall and a first bottom surface, a first raised member formed on said first cover portion and a second raised member formed on said first bottom surface approximately adjacent said first bottom surface;

said lid cover portion includes a circular circumferential flange adapted to fit over said lower perimeter flange and the upper rim, a second cover portion having a second recess portion that defines a second wall that is positioned approximately center of the second cover portion, a second bottom surface and a second recess wall that is axially aligned with an inner lip, a first opening formed in the second cover portion and a second opening formed in the second bottom surface;

wherein said first raised member sized and shaped to be received within said first opening such that said first raised member is an abutting communications with an inner edge of said first opening, and said second raised member sized and shaped to be received within said second opening such that said second raised member is in abutting communication with an inner edge of said second opening and wherein said tab member portion configured such that when said first raised member is manually pressed in a downward direction said second raised member downwardly separates from said second opening placing the lid in an open position, and wherein releasing said first raised member causes said first raised member to upwardly pass through said first opening and said second raised member to upwardly pass through said second opening placing the lid in a closed position.

2. The lid of claim 1, wherein said first opening is disposed between said second recess portion and said inner lip.

3. The lid of claim 2, wherein said second opening is formed adjacent the second wall of the second recess portion.

4. The lid of claim 3, wherein said first opening, having an elongated circular shape.

* * * * *